US009722292B2

(12) United States Patent
Matsumoto et al.

(10) Patent No.: US 9,722,292 B2
(45) Date of Patent: Aug. 1, 2017

(54) WIRELESS APPARATUS, WIRELESS ABNORMALITY NOTIFICATION SYSTEM USING SAME, AND WIRELESS REMOTE CONTROL SYSTEM

(75) Inventors: Kazuhiro Matsumoto, Osaka (JP); Takeshi Kohrogi, Osaka (JP); Hiroshi Yokota, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 241 days.

(21) Appl. No.: 13/634,433

(22) PCT Filed: Feb. 23, 2011

(86) PCT No.: PCT/IB2011/000354

§ 371 (c)(1),
(2), (4) Date: Sep. 12, 2012

(87) PCT Pub. No.: WO2011/114204

PCT Pub. Date: Sep. 22, 2011

(65) Prior Publication Data

US 2013/0009773 A1 Jan. 10, 2013

(30) Foreign Application Priority Data

Mar. 19, 2010 (JP) ..... 2010-064960
Jun. 25, 2010 (JP) ..... 2010-145533

(51) Int. Cl.
*G08B 1/08* (2006.01)
*H01Q 1/00* (2006.01)
(Continued)

(52) U.S. Cl.
CPC ..... *H01Q 1/007* (2013.01); *H01Q 1/48* (2013.01); *H01Q 1/22* (2013.01); *H01Q 9/30* (2013.01)

(58) Field of Classification Search
USPC ..... 340/539
See application file for complete search history.

(56) References Cited

U.S. PATENT DOCUMENTS 6,342,859 B1 1/2002 Kurz et al.
2004/0176811 A1* 9/2004 Von Arx et al. ..... 607/32
(Continued)

FOREIGN PATENT DOCUMENTS

JP 07-050873 2/1995
JP 2002-216261 8/2002
(Continued)

OTHER PUBLICATIONS

Taiwan Office action in Taiwan Patent Application No. 100160227, dated Dec. 24, 2014 along with an English translation thereof.
(Continued)

*Primary Examiner* — Brian Zimmerman
*Assistant Examiner* — Thomas McCormack
(74) *Attorney, Agent, or Firm* — Greenblum & Bernstein, P.L.C.

(57) ABSTRACT

A wireless apparatus includes an antenna, a circuit board configured to form a wireless communication circuit that is connected to the antenna, and a housing configured to accommodate the circuit board and formed by resin molding. A linear conductor extends from a ground of the circuit board.

9 Claims, 11 Drawing Sheets

(51) Int. Cl.

| | |
|---|---|
| ***H01Q 1/48*** | (2006.01) |
| *H01Q 1/22* | (2006.01) |
| *H01Q 9/30* | (2006.01) |

(56) References Cited

U.S. PATENT DOCUMENTS

| | | | | |
|---|---|---|---|---|
| 2005/0280547 | A1* | 12/2005 | Ropke | G08B 17/00 340/628 |
| 2006/0233356 | A1* | 10/2006 | Lu et al. | 379/433.01 |
| 2009/0051551 | A1* | 2/2009 | Pham et al. | 340/577 |
| 2009/0058737 | A1 | 3/2009 | Tsujimura et al. | |
| 2010/0194659 | A1* | 8/2010 | Chakam | H01Q 1/3241 343/866 |
| 2010/0295677 | A1* | 11/2010 | Egawa et al. | 340/540 |
| 2011/0068936 | A1 | 3/2011 | Shimada et al. | |

FOREIGN PATENT DOCUMENTS

| | | | | |
|---|---|---|---|---|
| JP | 2002216261 | * | 8/2002 | G08B 17/00 |
| JP | 2003-322569 | * | 11/2003 | |
| JP | 2003-347815 | | 12/2003 | |
| JP | 2008-187294 | | 8/2008 | |
| JP | 2008-199688 | | 8/2008 | |
| JP | 2009-065388 | | 3/2009 | |
| JP | 2009-237873 | | 10/2009 | |
| JP | 2010-039936 | | 2/2010 | |
| WO | 99/54956 | | 10/1999 | |

OTHER PUBLICATIONS

European Search Report in European Patent Application No. 11755752.0, mail date is Oct. 29, 2014.

* cited by examiner

WIRELESS APPARATUS, WIRELESS ABNORMALITY NOTIFICATION SYSTEM USING SAME, AND WIRELESS REMOTE CONTROL SYSTEM

FIELD OF THE INVENTION

The present invention relates to a wireless apparatus for wirelessly sending and receiving signals.

BACKGROUND OF THE INVENTION

Up to the present, fire alarms have been popularized that are devices using sensors disposed on the surfaces of the walls or ceilings of houses and function to sense smoke and provide notification to residents (e.g., see Japanese Unexamined Patent Application Publication No. 2010-39936). Such a type of alarm includes a smoke sensing unit configured to sense smoke, a speaker configured to issue the sound of an alarm, and a circuit board configured such that the smoke sensing unit and the speaker are connected thereto, and is thus referred to as a "household fire alarm." The smoke sensing unit senses smoke that is introduced via an introductory portion. The speaker is normally disposed on the front side of the fire alarm, that is, toward the inside of a room so that the sound of the alarm can efficiently reach residents. The circuit board, together with the speaker, is disposed on the indoor side of the fire alarm so that the line connecting the circuit board to the speaker does not pass through the above-described introductory portion and does not interrupt the entry of smoke (e.g., see FIG. 1 of Japanese Unexamined Patent Application Publication No. 2010-39936).

In wired connection-type household fire alarms, the wiring passes through spaces above the ceilings, which is not suitable for existing houses. On the other hand, wireless-type fire alarms can be easily installed and can thus be used in not only existing and newly constructed houses but can also be used in aggregate buildings.

It is important to design such fire alarms so that they are unnoticeable in order for a passersby to feel a sense of incompatibility and so that they are compact. A design is contemplated in which an antenna for wireless communication to the outside is contained in a fire alarm such that it is not exposed, thereby achieving a reduction in the size of the fire alarm.

When an antenna for wireless communication is contained in the fire alarm disclosed in Japanese Unexamined Patent Application Publication No. 2010-39936, it is considered preferable to dispose the antenna in a space (a space on the rear side of a circuit board, that is, a space near the surface of a ceiling or the surface of a wall) provided as an introductory portion for introducing smoke. The reason for this is that if the antenna is disposed on the front side of the circuit board, that is, on the inner side of a room, it is necessary to ensure a space for the antenna between the circuit board and the front cover of the fire alarm and it is difficult to reduce the size of the fire alarm.

However, when the antenna is disposed on the rear side of the circuit board, there is concern about the reduction in the gain of the antenna. The same problem is not limited to a fire alarm configured to detect smoke, and is common to a fire alarm configured to detect heat as well as to wireless apparatuses configured to send and receive signals when the degree of freedom of the layout of an antenna is low.

SUMMARY OF THE INVENTION

In view of the above, an object of the present invention is to provide a wireless apparatus for transmitting and receiving sensing signals via wireless communication based on radio waves, which is capable of both achieving the scale-down thereof and improving the gain of an antenna. Another object of the present invention is to provide a wireless apparatus, which can realize a small size so that it is unnoticeable when an event, such as an abnormality, does not occur, and which can take an appropriate action in conjunction with another wireless apparatus when an event, such as an abnormality, occurs.

In accordance with an aspect of the present invention, there is provided a wireless apparatus including: an antenna, a circuit board configured to form a wireless communication circuit that is connected to the antenna, and a housing configured to accommodate the circuit board and formed by resin molding, wherein a linear conductor extends from a ground of the circuit board.

The circuit board may be provided with a concave cutout portion, the antenna may be disposed on one end side of the circuit board, and the conductor may extend from the other end side of the circuit board.

The total electrical length which is a sum of an overall equivalent electrical length of a wiring pattern and electrical and electronic circuits on the circuit board, except for the antenna, and an electrical length of the conductor may be ¼ of a wavelength of a carrier that is used in wireless communication.

The antenna may be accommodated inside the housing.

The antenna may be disposed between the circuit board and an attachment surface of the housing.

The conductor may be disposed on a same plane as the circuit board or may be disposed opposite to the antenna with the circuit board disposed therebetween.

The conductor may extend along an inside wall of the housing.

The conductor may extend from the other end side of the circuit board to one end side thereof.

Ribs adapted to reinforce the housing may be formed on an inside wall of the housing, the ribs having depressions adapted to allow the conductor to be fitted thereinto.

A surface of the conductor may be coated with an insulating coating.

A battery adapted to supply power to the wireless transmission circuit of the circuit board may be disposed in the housing, and a front end of the conductor that is not directly connected to the ground may be directly connected to a negative electrode of the battery.

In accordance with another aspect of the present invention, there is provided a wireless abnormality notification system including a plurality of fire alarms each including the wireless apparatus as described above and a sound notification unit configured to issue a sound of an alarm, wherein any one of the fire alarms that senses a fire wirelessly communicates with the other fire alarms and provides notification of the fire to the other fire alarms, so that a sound notification unit of at least one of the fire alarms issues a sound to notify the fire.

In accordance with still another aspect of the present invention, there is provided a wireless remote control system including: the wireless apparatus as described above, a receiver configured to receive a wireless signal from the wireless apparatus, and equipment whose operation is controlled by the receiver.

In accordance with the present invention, the conductor extends from the ground of the circuit board, and thus the ground of the wireless communication circuit is enhanced, thereby improving the gain of the antenna. Furthermore, the wireless communication circuit is insulated from the outside of the wireless apparatus by the housing formed by the resin molding, and thus the wireless communication circuit can be protected against an accidental discharge of static electricity.

Furthermore, the antenna is accommodated inside the housing, and thus the appearance of the wireless apparatus can be made simple or improved upon.

Furthermore, the antenna is disposed between the circuit board and the attachment surface of the housing, that is, on the rear side of the circuit board, and thus the front side of the circuit board can be made compact. Furthermore, components other than the antenna may be disposed between the circuit board and the attachment surface of the housing. Accordingly, the degree of freedom of the layout of parts within the housing can be increased.

Furthermore, the conductor is disposed in the same plane as the circuit board or is disposed opposite to the antenna with the circuit board disposed therebetween, and thus it is possible to avoid the interference between the conductor and the antenna while reducing the size of the wireless apparatus.

Furthermore, the conductor that forms the ground of the wireless communication circuit extends along the inside wall of the housing, and thus the ground can be efficiently enhanced regardless of the limited size of the housing.

Furthermore, the conductor extends from the other end side of the circuit board to one end side thereof, and thus the ground of the wireless communication circuit can be further enhanced.

Furthermore, the conductor can be securely held with the simple configuration while increasing the strength of the housing, and the reliability of the wireless apparatus is increased.

Furthermore, the coating formed on the surface of the conductor can reliably insulate the conductor from other electrical configurations, and the reliability of the wireless apparatus is increased.

Furthermore, the front end of the conductor connected to the ground of the wireless communication circuit is directly connected to the negative electrode of the battery, thereby simplifying the configuration of the wiring of the circuit board and also achieving a reduction in the cost.

Furthermore, when any one of the fire alarms senses a fire, the sound notification units of the other fire alarms issue a large sound to notify the fire, so that notification of the fire can be provided immediately after the fire has occurred. Furthermore, even a small-sized fire alarm can increase the gain of the antenna, and thus the reliability of wireless communication can be sufficiently ensured.

Furthermore, it is possible to increase the gain of the antenna of the wireless apparatus while reducing the size of the wireless apparatus, thereby sufficiently ensuring the reliability of wireless communication between the wireless apparatus and the receiver and also accurately controlling the operation of the equipment.

DETAILED DESCRIPTION OF THE PREFERRED EMBODIMENTS

First Embodiment

Figure 1:
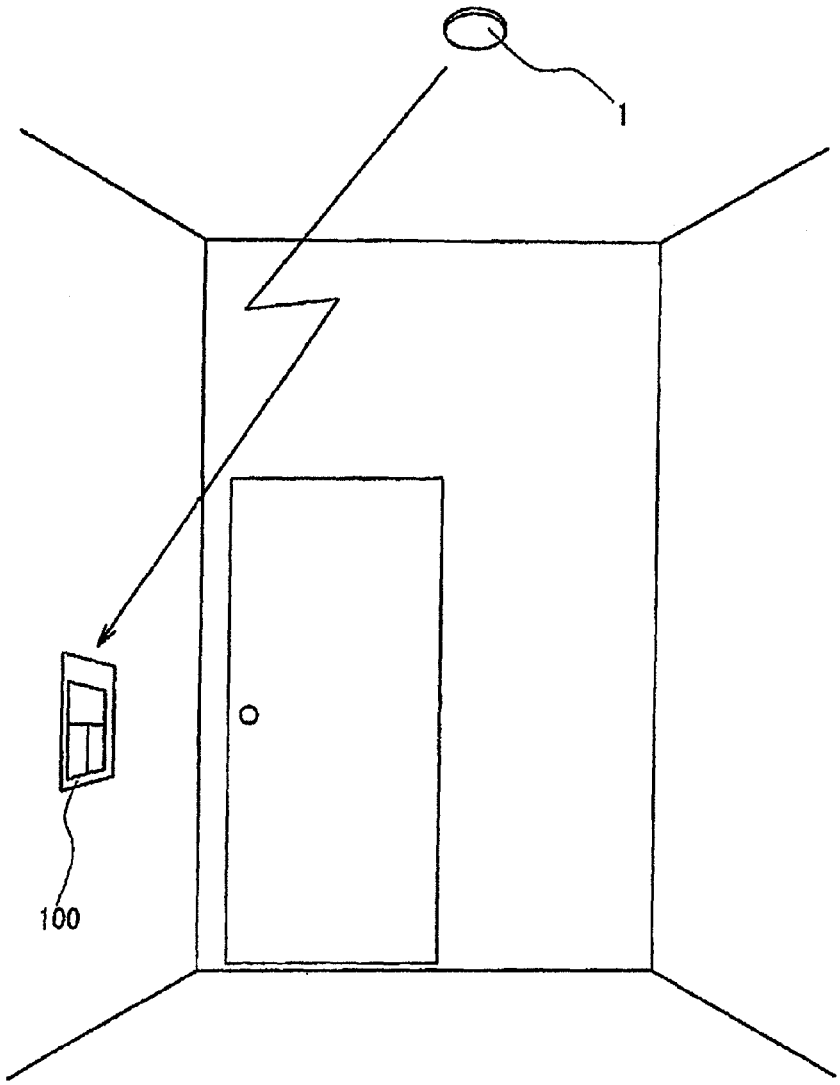
FIG. 1 is a perspective view showing the use of a fire alarm in which a wireless apparatus in accordance with the present invention is contained.

A fire alarm configured using a wireless apparatus in accordance with a first embodiment of the present invention will now be described. A fire alarm 1 uses a battery as a power source, and senses smoke to send a sensing signal via wireless communication based on radio waves. As shown in FIG. 1, the fire alarm 1 is attached, for example, onto the surface of a ceiling with a double-sided adhesive tape, an adhesive, screws or the like. Although in the drawing, the fire alarm 1 is illustrated as being provided on the surface of the ceiling, it may be provided on the surface of a wall. FIG. 1 illustrates a situation in which the wireless household fire alarm 1 and an indoor intercom unit 100 communicate with each other via a wireless connection. Here, the indoor intercom unit 100 may be communicatively connected to a sub-main unit or the like via a wired connection using an intercom line or a power line, rather than via wireless communication. Here, for the sake of shortening the description, the indoor intercom unit 100 will be described not as a sub-main unit but a main unit. The main unit 100 provided on the surface of a wall is provided with a wireless reception unit that receives a sensing signal from the fire alarm 1. When the fire alarm 1 senses smoke, it issues the sound of an alarm and sends a sensing signal. The sensing signal sent by the fire alarm 1 is received by the main unit 100 of an intercom and then sent to one or more subsidiary units (not shown) that are provided in respective rooms. When the main unit 100 and subsidiary unit of the intercom receive a sensing signal, they operate while issuing a large alarm sound, thereby notifying residents of the occurrence of a fire.

Figure 2:
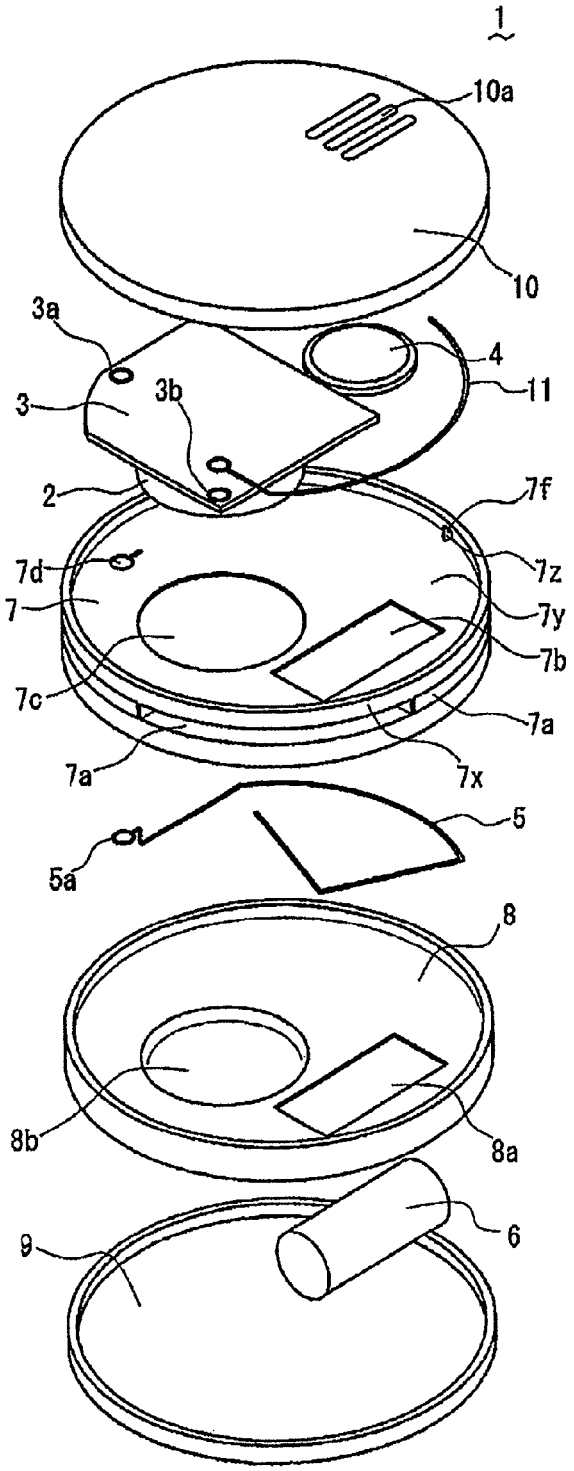
FIG. 2 is an assembly perspective view showing the configuration of a fire alarm which contains a wireless apparatus in accordance with a first embodiment of the present invention.
Figure 3:
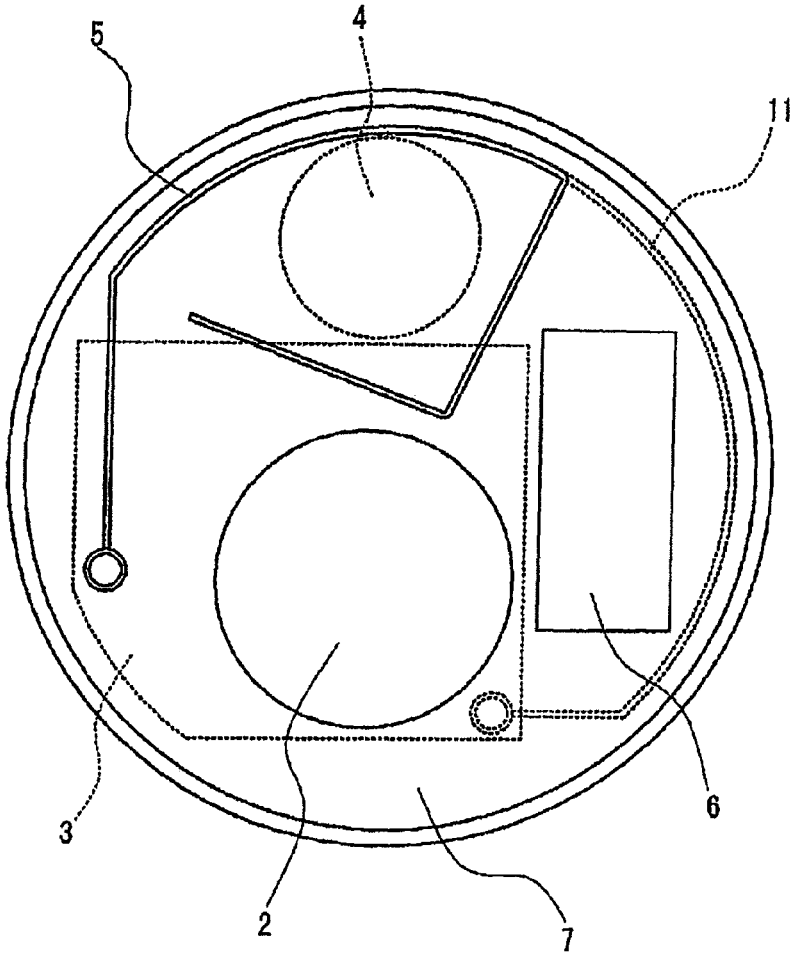
FIG. 3 is a plan view showing the configuration of the fire alarm.
Figure 4:
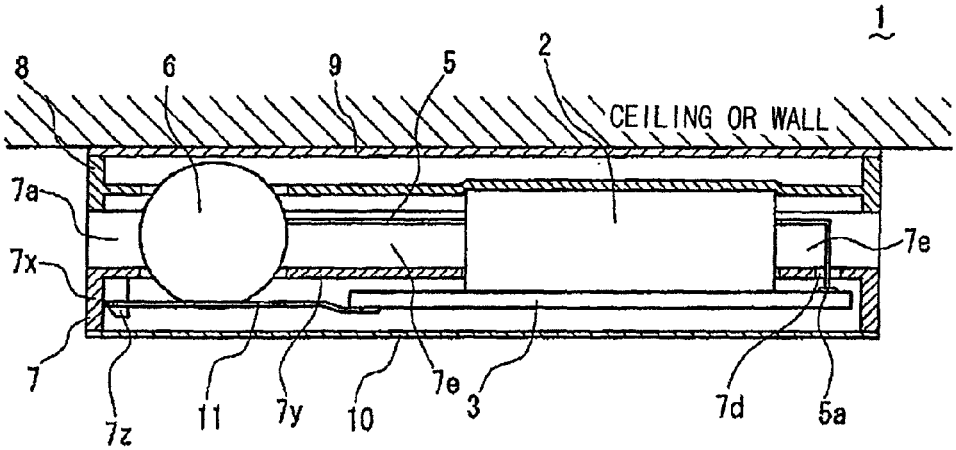
FIG. 4 is a sectional view showing the configuration of the fire alarm.

FIGS. 2, 3 and 4 show the configuration of the fire alarm 1. The fire alarm 1 includes a smoke sensing unit 2, a circuit board 3, a speaker 4, an antenna 5, a battery 6, a first housing 7, a second housing 8, an attachment base 9, a front cover 10, and a conductor 11. FIG. 3 shows the fire alarm 1 with the base 9 and the second housing 8 removed, which is viewed from the rear side thereof.

The antenna 5 and the conductor 11 are formed of linear conductors, and extend from approximately opposite corners of the circuit board 3 along the inner circumferential surface of the first housing 7. The antenna 5 is disposed on the rear side of the circuit board 3. The conductor 11 is disposed in the same plane as the circuit board 3 or on the front side of the circuit board 3.

The smoke sensing unit 2 is disposed on the rear side of the circuit board 3, and senses smoke and then outputs an electrical signal. The configuration of the smoke sensing unit 2 is equivalent to that disclosed in Japanese Unexamined Patent Application Publication 2010-39936, and thus a description thereof will be omitted.

A control unit or a wireless transmission circuit is formed on the circuit board 3. The control unit causes the speaker 4 to issue a loud sound, or controls the wireless transmission circuit in response to the electrical signal output from the smoke sensing unit 2. Since the wireless transmission circuit includes an oscillation circuit, etc., it generates carrier waves at a predetermined frequency, superimposes a sensing signal on the carrier signal and then sends the carrier signal. Terminals 3*a* and 3*b* to which the antenna 5 and the conductor 11 are connected are provided at ends of the circuit board 3. The terminal 3*a* is connected to the wireless transmission circuit, and the terminal 3*b* is connected to the ground of the circuit board 3.

The speaker 4 is disposed near the front cover 10, that is, on the inner side of the fire alarm 1 mounted on the surface of a ceiling or the surface of a wall. The speaker 4 is provided in approximately the same plane as the circuit board 3. Accordingly, a connection line that connects the circuit board 3 to the speaker 4 can be disposed in front of the partition 7*y* of the first housing 7, and the inflow of smoke into the smoke sensing unit 2 is not disrupted.

The antenna 5 is connected to the terminal 3*a* at the base portion 5*a* thereof, is erected to be approximately perpendicular to the circuit board 3, is bent at approximately 90 degrees in parallel with the circuit board 3, is curved along the circumferential wall of the first housing 7, and then is bent not to interfere with the battery 6 and the smoke sensing unit 2. The distance between the portions of the antenna 5 and the circuit board 3 which are in parallel is approximately established so that desired gain can be achieved.

The antenna 5 is disposed in an introductory portion 7*e* behind the partition 7*y* of the first housing 7. That is, the antenna 5 is attached to the circuit board 3, and is disposed between the circuit board 3 and the mounting surface of the base 9. The base portion 5*a* of the antenna 5 is inserted through a hole 7*d* formed in the first housing 7 to the front, and is then connected to the terminal 3*a*. A screw or the like (not shown) is used to connect the base portion 5*a* with the terminal 3*a*, if desired. The battery 6 is mounted on a battery seat 8*a* of the second housing 8, and supplies power to the components. The length of the antenna 5 is preferably set such that the electrical length thereof is about ¼ of the wavelength λ (lambda) of a carrier that is used in wireless communication.

The first housing 7 has a slit 7*a* configured to allow the outside of the fire alarm 1 to communicate with the introductory portion 7*e*, an opening 7*c* configured to insert the smoke sensing unit 2 through the introductory portion 7*e*, an opening 7*b* configured to avoid the interference of the battery 6, and a hole 7*d* configured to allow the base portion 5*a* of the antenna 5 to pass therethrough. The slit 7*a* is formed through the circumferential wall 7*x* of the first housing 7, and the opening 7*b*, the opening 7*c* and the hole 7*d* are formed through the partition 7*y* of the first housing 7. The internal space of the fire alarm 1 is partitioned into a front side and a rear side by the partition 7*y*. The second housing 8 has the battery seat 8*a* configured such that the battery 6 is mounted thereon and a depression 8*b* configured to avoid the interference of the smoke sensing unit 2. The space surrounded by the first housing 7 and the second housing 8 forms the introductory portion 7*e* that introduce smoke to a location near the smoke sensing unit 2. Furthermore, ribs 7*z* adapted to reinforce the first housing 7 are appropriately provided on the inside surface of the circumferential wall 7*x*.

The attachment base 9 has an attachment surface that allows the fire alarm 1 to be attached on the surface of a ceiling or the surface of a wall. Furthermore, when the battery 6 is replaced, the body portion of the fire alarm 1 is separated by separating the second housing 8 from the attachment base 9, thereby facilitating access to the battery 6. The front cover 10 is mounted on the front of the first housing 7. Slits 10*a* adapted to efficiently transmit the sound of the speaker 4 are provided in the front cover 10. Furthermore, a housing including the first housing 7, the second housing 8, the attachment base 9 and the front cover 10 is formed by resin molding in order to insulate the circuit board 3 from the outside of the fire alarm 1 and protect the circuit board 3 against the entry of an accidental discharge of static electricity.

The conductor 11 is a so-called counterpoise and is connected to the ground of the circuit board 3 via the terminal 3*b*. A screw or the like (not shown) is used to connect the conductor 11 to the terminal 3*b*, if desired. Accordingly, the conductor 11 extends from the ground of the circuit board 3. The conductor 11 is disposed in the same plane as the circuit board 3. If there is a space between the circuit board 3 and the front cover 10, the conductor 11 may be disposed opposite to the antenna 5 in front of the circuit board 2, that is, with the circuit board 3 disposed between the conductor 11 and the antenna 5. Furthermore, the conductor 11 extends along the inside surface of the circumferential wall 7*x* of the first housing 7, and is inserted into and maintained in depressions 7*f* formed in the ribs 7*z* provided on the inside of the circumferential wall 7*x*. Here, since the electrical length from one end of the circuit board 3 to the other end thereof is designed to correspond to ¼ (quarter wavelength) of the wavelength λ of a carrier for a wireless signal, it is preferable that, in a well-known antenna gain test, the length of the conductor 11 is made variable and by using the length of conductor 11 as a parameter, the length of the conductor 11 is determined such that the carrier for the wireless signal can be received in excess of a prescribed reception level in terms of design. The circuit board 3 (of course, except for the conductor 11) designed as described above is configured such that the total electrical length which is the sum of the overall equivalent electrical length of a wiring pattern and electric and electronic circuits on the circuit board 3 and the electrical length of the conductor 11 is equivalent to ¼ (quarter wavelength) of the wavelength of a carrier that is used in wireless communication.

In accordance with the fire alarm 1 configured as described above, the conductor 11 extends from the ground of the circuit board 3, and thus the ground of the circuit board 3 is enhanced, thereby enhancing the gain of the antenna 5. Furthermore, the circuit board 3 is insulated from the outside of the fire alarm 1 by the first housing 7, the second housing 8, the attachment base 9 and the front cover 10 formed by resin molding, thereby protecting the fire alarm 1 against the entry of an accidental discharge of static electricity.

Furthermore, the antenna 5 is accommodated in the first housing 7, the second housing 8, the attachment base 9 and the front cover 10, and thus the appearance of the fire alarm 1 is simplified and refined. Furthermore, the antenna 5 is attached to the circuit board 3 and disposed between the circuit board 3 and the mounting surface of the base 9, thereby allowing the front side of the circuit board 3 to be compact. Furthermore, in the case in which it is necessary to attach a component (for example, the smoke sensing unit 2) to the circuit board 3 and dispose the component between the circuit board 3 and the attachment surface of the base 9 in addition to the antenna 5, it is possible to accommodate the component together with the antenna 5. Accordingly, the degree of freedom of the layout of parts in the housing can be increased.

Furthermore, the conductor 11 is disposed in the same plane as the circuit board 3, or is disposed opposite to the antenna 5 with the circuit board 3 disposed therebetween, and thus the size of the fire alarm 1 can be reduced and the interference between the conductor 11 and the antenna 5 can be prevented. Furthermore, the conductor 11 that forms the ground of the circuit board 3 extends along the inside wall of the first housing 7, and thus the ground can be efficiently enhanced in spite of a limited housing size.

Furthermore, the ribs 7*z* adapted to reinforce the first housing 7 are formed on the inside of the circumferential wall 7*x* and the depressions adapted to maintain the conductor 11 are formed in the ribs 7*z*, so that the strength of the first housing 7 can be increased with the simple configuration thereof and the conductor 11 can be reliably maintained, which increases the reliability of the fire alarm 1.

Second Embodiment

Figure 5:
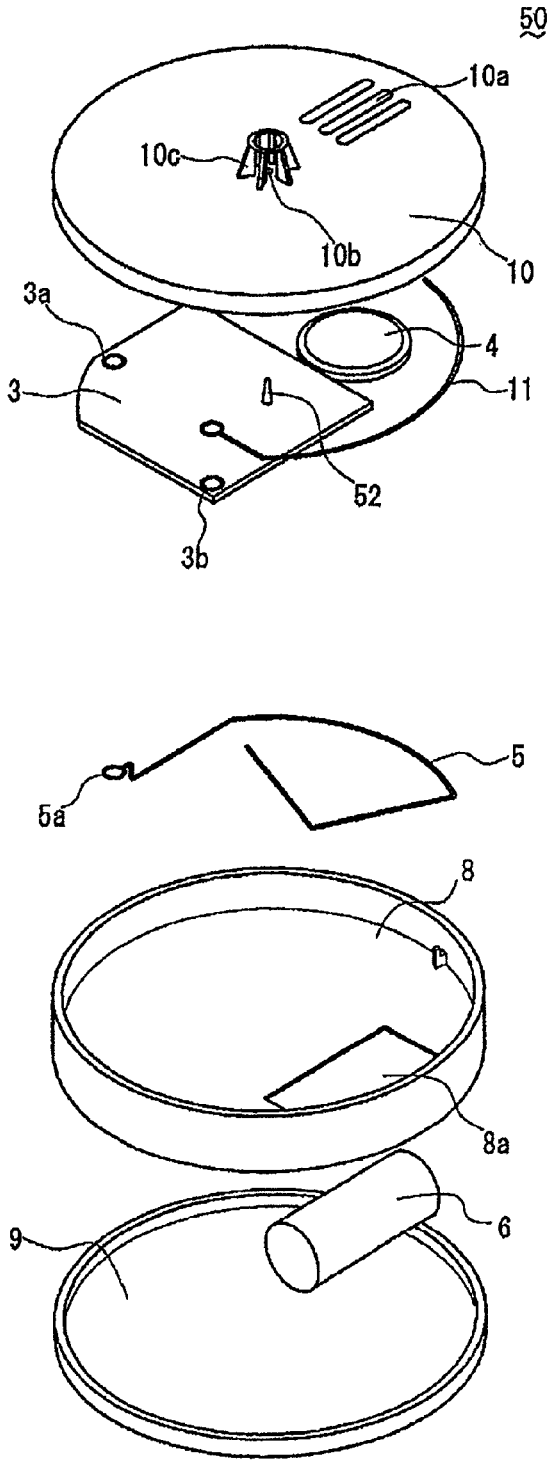
FIG. 5 is an assembly perspective view showing the configuration of a fire alarm in which a wireless apparatus is contained in accordance with a second embodiment of the present invention.
Figure 6:
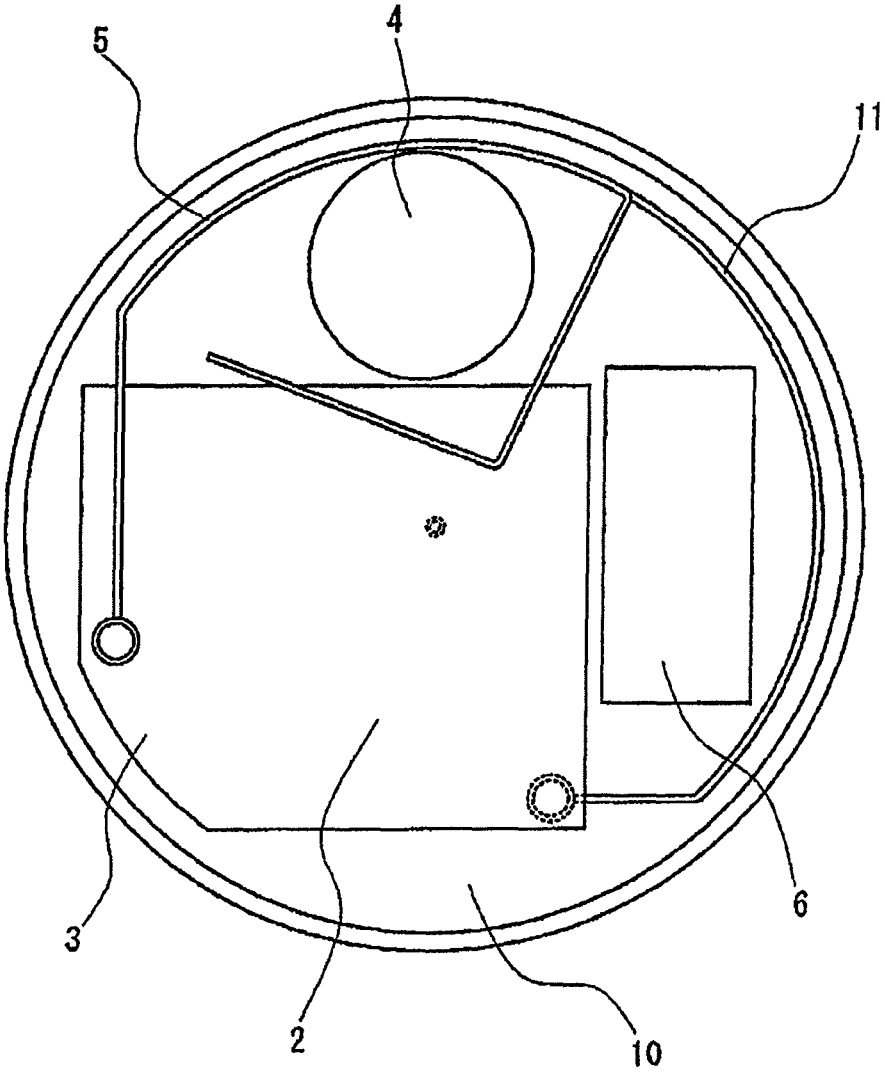
FIG. 6 is a plan view showing the configuration of the fire alarm.

FIGS. 5 and 6 show a fire alarm using a wireless apparatus in accordance with a second embodiment of the present invention. The fire alarm 50 of the second embodiment is different from the fire alarm 1 of the first embodiment in that the former senses heat and the latter senses smoke.

The fire alarm 50 includes a heat sensing unit 52, a circuit board 3, a speaker 4, an antenna 5, a battery 6, a housing 58, an attachment base 9, a front cover 10, and a conductor 11. Furthermore, FIG. 6 shows the fire alarm 50 with the base 9 and the housing 58 having been removed, which is viewed from the rear side thereof.

The antenna 5 and the conductor 11 are formed of linear conductors, and extend from approximately opposite corners of the circuit board 3 along the inner circumferential surface of the housing 58. The antenna 5 is disposed on the rear side of the circuit board 3. The conductor 11 is disposed in the same plane as the circuit board 3 or on the front side of the circuit board 3.

The heat sensing unit 52 is disposed on the front side of the circuit board 3, and senses heat and then outputs an electrical signal.

A hole 10*b* adapted to allow the heat sensing unit 52 to protrude and a guard portion 10*c* adapted to protect the tip of the heat sensing unit 52 are formed on the front cover 10. In this embodiment, the heat sensing unit 52 is exposed to the outside of the front cover 10, and thus the introductory portion 7*e* adapted to introduce smoke is not necessary, with the result that the first housing 7 having the slit 7*a* is omitted. Since the dispositions and shapes of the antenna 5 and the conductor 11 in the fire alarm 50 of the second embodiment are the same as those in the fire alarm 1 of the first embodiment, descriptions thereof will be omitted.

An example of the use of this embodiment will now be described with reference to FIG. 7. The wireless transceiver of this embodiment is used for a specific type of wireless apparatuses Xn (n is a natural number). The specific type of wireless apparatuses Xn includes at least one type of environmental measurement sensors selected from among a variety of types of environmental measurement sensors Sm (m is a natural number), including optical sensors S1, heat sensors S2, chemical sensors S3, and pressure sensors S4, . . . . The wireless apparatuses Xn are some types of sensors that have sensing functionality capable of sensing changes in areas near the locations at which they are installed after they have been attached to the surface of a ceiling or the surfaces of walls and send radio waves to other wireless apparatuses Xn when sensing the changes in the surrounding environment so that the other wireless apparatuses Xn can become aware of the changes. Here, the types of environmental measurement sensors Sm are not necessarily uniform, but may vary for the wireless apparatuses Xn.

For example, the wireless apparatus X1 solely activates its own wireless transceiver at specific reception intervals. Furthermore, if the wireless apparatus X1 cannot receive a first type of wireless signal Sig1 having a finite time length from any one of the other wireless apparatuses X2, X3, X4, and . . . , the wireless apparatus X1 immediately stops its own wireless transceiver, thereby preventing the power of a battery from being consumed. Meanwhile, if the wireless apparatus X1 can receive the first type of wireless signal Sig1, the wireless apparatus X1 sends a second type of wireless signal Sig2 indicative of the fact that a first type of wireless signal Sig1 could be received from its own wireless transceiver. The second type of wireless signal Sig2 is indicative not only of the fact that a first type of wireless signal Sig1 could be received, but also of the purport of the transmission of the first type of wireless signal Sig1 to a plurality of other unspecified wireless apparatuses X2, X3, X4, and . . . .

Figure 7:
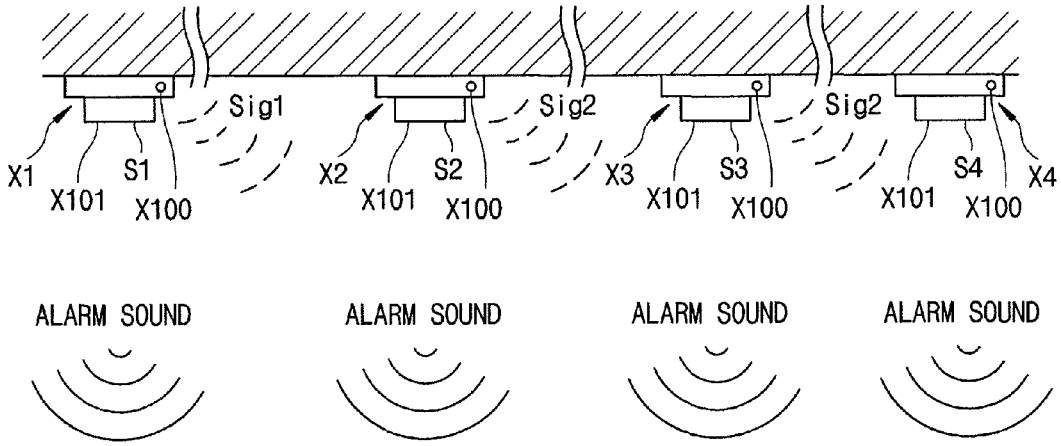
FIG. 7 is a diagram showing the configuration and operation of a wireless abnormality notification system using the wireless apparatus of the present invention.

As illustrated in FIG. 7, these wireless apparatuses Xn have at least one of a display notification unit X100 adapted to appeal to a humans' visual sensation and a sound notification unit (speaker) X101 adapted to appeal to the ear. When any one of the wireless apparatuses Xn (in FIG. 7, the wireless apparatus X1) senses an abnormality in the surroundings, the wireless apparatus Xn activates the display notification unit X100 or the sound notification unit X101, thereby providing notification of the occurrence of the abnormality, and also sends the first type of wireless signal Sig1.

All the wireless apparatuses except for the wireless apparatus that received the corresponding first type of wireless signal Sig1 (in FIG. 7, only the wireless apparatus X2 closest to the wireless apparatus X1) receive the corresponding first type of wireless signal Sig1, and perform address analysis thereon. Furthermore, a second type of wireless signal Sig2 is sent to the other wireless apparatuses that have not received the corresponding first type of wireless signal Sig1 (in FIG. 7, the wireless apparatuses X3 and X4, other than the wireless apparatuses X1 and X2).

Thereafter, the wireless apparatus X3 that has received a second type of wireless signal Sig2 sends a second type of wireless signal Sig2 to the wireless apparatus X4 (the reason for this is to, in the wireless apparatus X3, prevent it from being determined whether the second type of wireless signal Sig2 sent from the wireless apparatus X2 could have been received by the wireless apparatus X4.

Accordingly, not only the one wireless apparatus X1 that first sensed the occurrence of an abnormality but also the grouped wireless apparatuses X1, X2, X3 and X4 all operate in conjunction with each other, and may notify the surroundings of the occurrence of the abnormality. Examples of the wireless communication system for providing notification of the alarm include a household fire alarm (a fire alarm having a sound notification unit) and a system thereof (a wireless abnormality notification system). This system may be of a wireless communication type that provides notification in the above-described wireless transmission sequence, or of a wireless communication type that communicates in time division slots using the same carrier frequency. Furthermore, it may be of a wireless communication type that performs transmission in a multi-hop manner.

Figure 8:
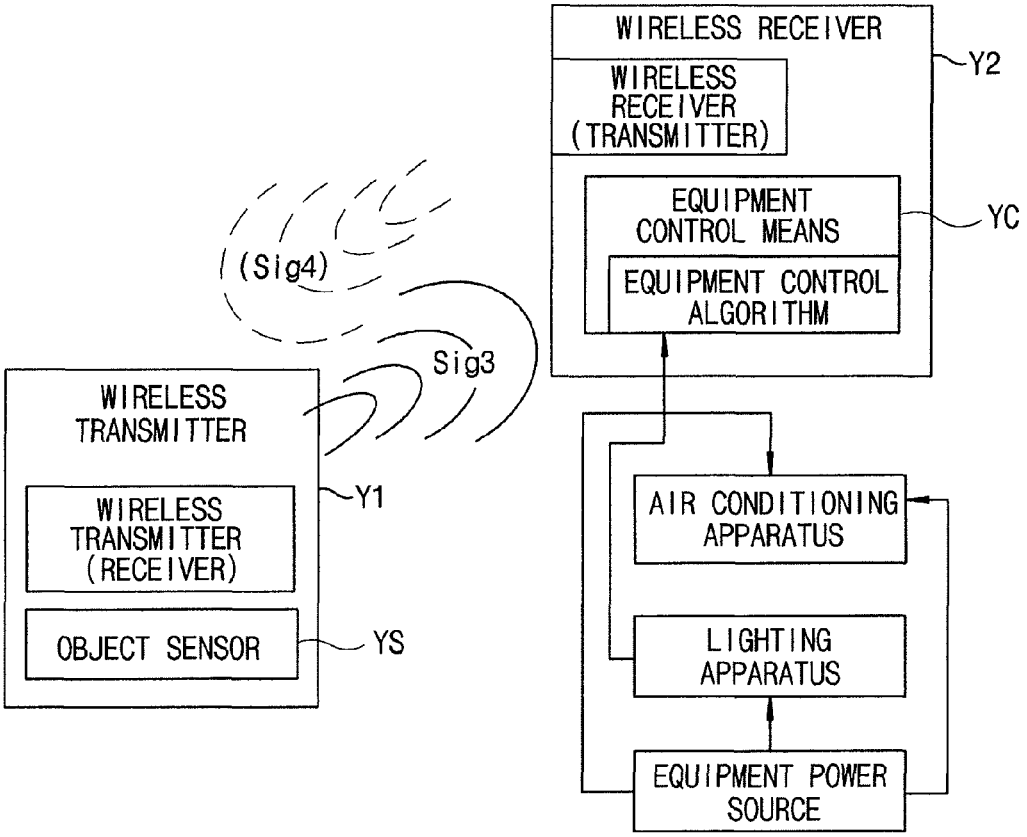
FIG. 8 is a diagram showing the configuration and operation of a wireless remote control system using the wireless apparatus of the present invention.

Furthermore, the wireless transceiver related to the present invention may be applied not only to the above-described surrounding monitoring system using the wireless sensor group, but also to the wireless transmitter Y1 and wireless receiver Y2 of the wireless remote control system such as that shown in FIG. 8. This wireless transmitter Y1 has at least transmission functionality of the wireless transceiver related to the present invention, and also includes an object sensor YS capable of sensing the approach of an object, such as a human body or an obstacle, in a contact or non-contact manner. The wireless receiver Y2 has at least reception functionality of the wireless transceiver, and also includes equipment control communication means YC. The equipment control communication means YC performs remote communication, having weak possibility of interfering with wireless communication with the wireless transmitter, with an air conditioning apparatus, a lighting apparatus, an equipment power source, or equipment responsible for the handling of an environment in a specific place. Signals may be sent between the equipment control communication means YC and the equipment via a wired connection or a wireless connection.

The wireless transmitter that has sensed the approach of a human body or an obstacle thereto using the object sensor YS sends a wireless signal Sig3 indicative of the sensing of the object sensor YS to the wireless receiver Y2 by operating the wireless transceiver. The wireless receiver Y2 that has received the wireless signal Sig3 remotely controls equipment control communication means YC via an equipment control algorithm (which may perform only ON and OFF of the power source of equipment, such as an air conditioning apparatus or a lighting apparatus) that was applied to the equipment control communication means YC in advance. That is, the wireless receiver Y2 selects target equipment from among a group of equipment including an air conditioning apparatus, a lighting apparatus and an equipment power source, determines the operating mode of the target equipment in accordance with the received wireless signal Sig3, and performs remote control of the equipment based on the results of the selection and the determination.

Furthermore, in this case, the wireless receiver Y2 may send an answerback signal Sig4 indicative of the successful reception or the analysis of content to the wireless transmitter Y from its wireless transceiver. In this case, each of the wireless transmitter Y1 and the wireless receiver Y2 needs to have wireless transmission functionality and wireless reception functionality, and, for example, the wireless transceiver may employ different frequencies for transmission and reception as carrier frequencies that carry wireless signals.

Furthermore, the present invention is not limited to the configuration of the embodiment, but at least the conductor 11 may extend from the ground of the circuit board 3. Furthermore, in the circuit board 3, the wireless transmission circuit is responsible for the function of sending the sensing signal of the smoke sensing unit 2 via wireless communication based on radio waves, and a variety of modifications may be made depending on the purposes. For example, in the case in which the wireless apparatus of the present invention is applied to a wireless apparatus requiring wireless reception functionality (in the above-described embodiment, the main unit 100 of the intercom or the like), a wireless reception circuit may be provided in place of the wireless transmission circuit. Furthermore, an apparatus requiring wireless transmission and reception functions are preferably provided with wireless transmission and reception circuits. This means that targets to which the conductor 11 of the present invention is applied may be not only a wireless receiver but also a wireless transmitter and may also be widely applied to wireless transceivers, such as a typical wireless apparatus in which the degree of freedom of the layout of an antenna is low.

Furthermore, the length of the conductor 11 may be appropriately determined depending on the frequency. For example, the conductor 11 may extend from one end of the rectangular circuit board 3 to the other end thereof. Using this configuration, the further enhancement of the ground of the circuit board 3 is made possible. Furthermore, an insulating coating may be applied to the surface of the conductor 11, if desired. Using this configuration, the conductor 11 can be reliably insulated from the other electrical configurations and the reliability of the fire alarm is also improved by the coating formed on the surface of the conductor 11.

Furthermore, the front end of the conductor 11 that is not connected to the ground terminal 3*b* may be directly connected to the negative electrode of the battery 6. With such configuration, the front end of the conductor 11 that is connected to the ground of the circuit board 3 is directly connected to the negative electrode of the battery 6, so that the configuration of the wiring on the circuit board 3 can be simplified and a reduction in cost can be achieved.

Furthermore, the length of the ground can be increased by winding the conductor 11 around a spirally shaped object or forming the conductor 11 in a meandering shape along the inside wall of the first housing 7. Furthermore, the connection between the conductor 11 and the ground is not limited to a connection using a screw, but may be a connection that uses a connector or a connection formed using soldering.

Furthermore, the wireless apparatus is not limited to the shape in which it is contained in the above-described disk-shaped fire alarm, but may be widely applied to, for example, typical box-shaped electronic apparatuses having wireless communication functionality.

Third Embodiment

Figure 9:
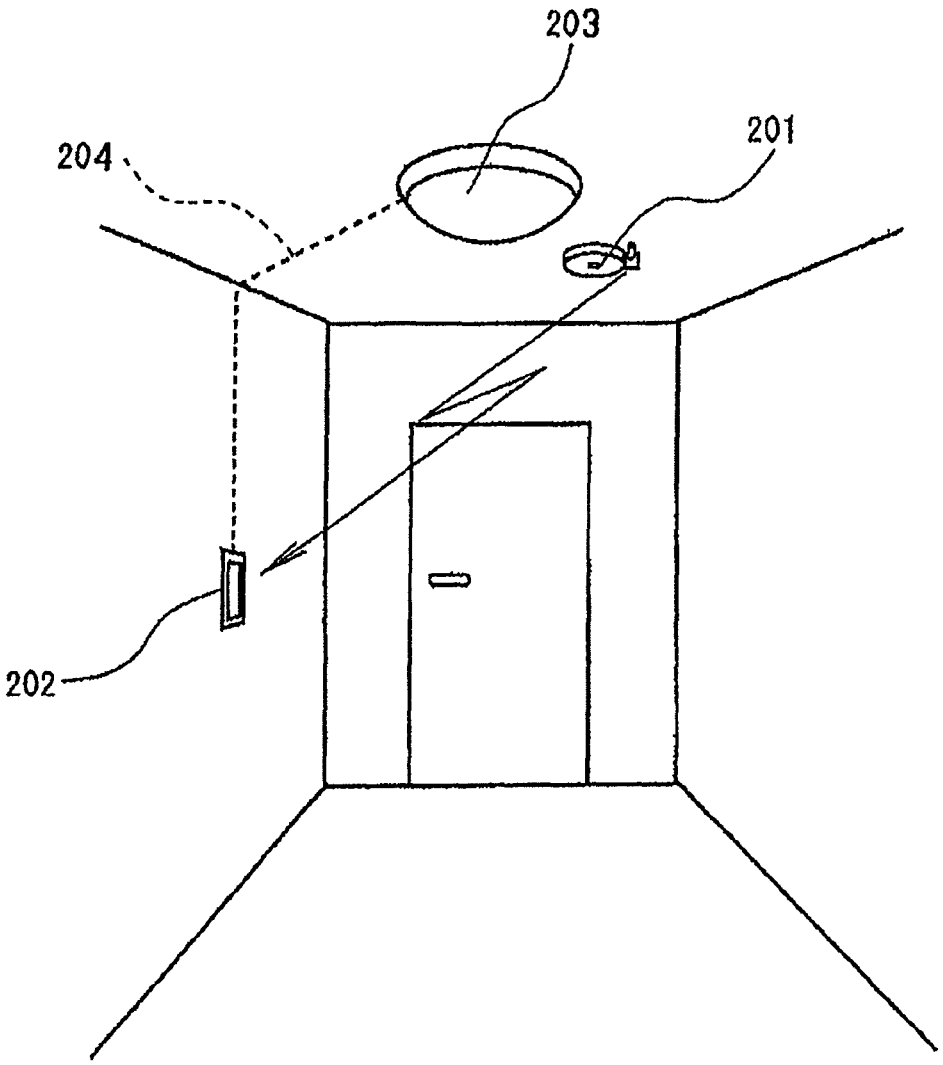
FIG. 9 is a perspective view showing the use of a human body sensor which contains a wireless apparatus in accordance with the present invention.

A human body sensor employing a wireless apparatus in accordance with a third embodiment of the present invention will be described. The human body sensor 201 uses a battery as its power source and sends sensing signals via wireless communication based on radio waves, like the fire alarm 1 of the above embodiment. As shown in FIG. 9, the human body sensor 201 is attached to, for example, a ceiling using double-sided adhesive tape, an adhesive, or a screw. A switch 202 provided on the surface of a wall is provided with a wireless reception unit adapted to receive a sensing signal from the human body sensor 201. Furthermore, the switch 202 is connected to a lighting apparatus 203 provided on the ceiling via an electric line 204.

The switch 202 is, for example, an electronic switch (load control device) using a noncontact switch device such as a triac, and may replace a conventional two-wire switch that mechanically switches between contacts, without requiring wiring work. In line with this, the human body sensor 201 may be also installed additionally in an existing house without requiring wiring work. The human body sensor 201 and the switch 202 may communicate with each other, via, for example, wireless communication based on radio waves, such as a specific low-power wireless communication. Accordingly, when the presence of a human is sensed by the human body sensor 201, a sensing signal is sent to the switch 202 and then the switch 202 turns on the lighting apparatus 203. Furthermore, when the presence of a human is not sensed anymore by the human body sensor 201, a non-sensing signal is sent to the switch 202 after the passage of a predetermined amount of time and then the switch 202 turns off the lighting apparatus 203.

Figure 10:
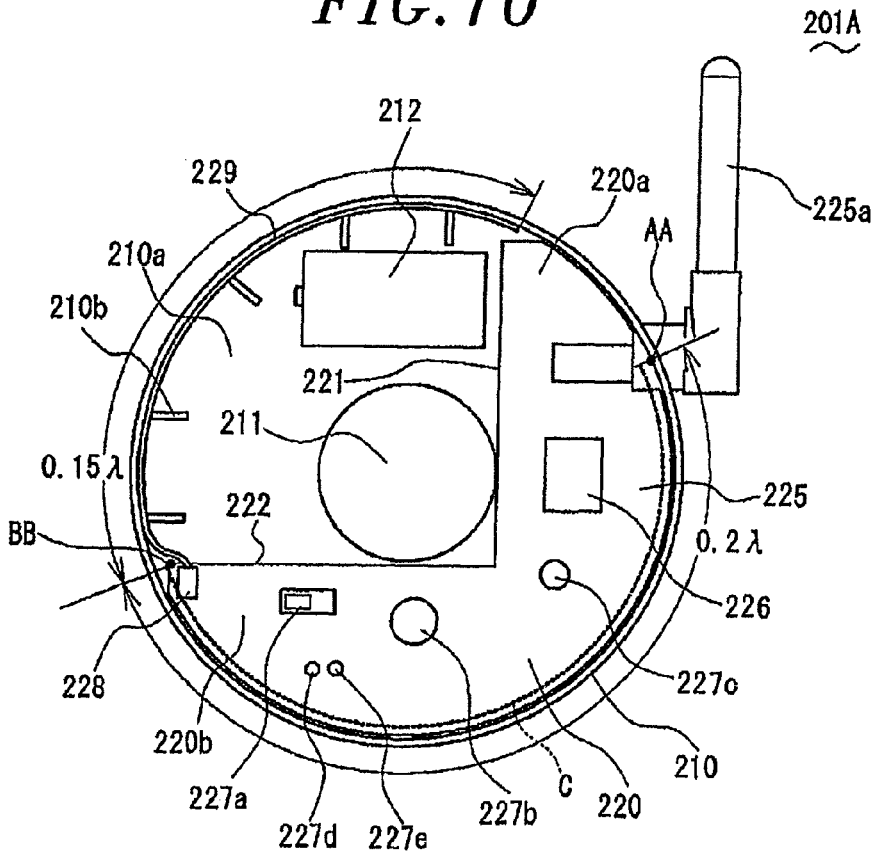
FIG. 10 is a front view showing the configuration of a human body sensor in accordance with a third embodiment of the present invention, with its cover removed.

FIG. 10 shows the configuration of an example of the human body sensor 201 with the cover of the human body sensor 201A removed. This human body sensor 201A is attached to a ceiling using double-sided adhesive tape, as described above. The housing 210 is approximately circular in shape when viewed from the front thereof. The housing 210 is formed by resin molding in order to insulate the wireless transmission unit 225 from the outside of the human body sensor 201A and to protect the wireless transmission unit 225 against the entry of an accidental discharge of static electricity. A sensor unit 211 formed of an infrared sensor, or an illuminance sensor is provided at the center of a mounting surface 210*a* of the housing 210 (opposite to the surface attached onto the ceiling using the double-sided adhesive tape). The sensor unit 211 is, for example, circular in shape when viewed from the front thereof. Furthermore, a circuit board 220 and a battery 212 are mounted on the mounting surface 210*a*.

Part of the periphery of the circuit board 220 is rounded to correspond with the circular shape of the housing 210, and the remaining part thereof is cut out at right angles to avoid the sensor unit 211 and the battery 212. That is, the circuit board 220 has first and second sides 221 and 222 which are perpendicular to each other, and the portion in which the first and second sides 221 and 222 form right angles is a cutout portion. Furthermore, the first and second sides 221 and 222 are disposed on the mounting surface 210*a* to be approximately equidistant to the sensor unit 211 (in the example of FIG. 10, to approximately circumscribe the circle of the sensor unit 211). Since the sensor unit 211 and the battery 212 having large heights can be disposed in the cutout portion of the circuit board 220 as described above, it is easy to suppress the height of the human body sensor 201A.

The circuit board 220 includes a wireless transmission unit (wireless communication circuit) 225 configured to send a sensing signal of the sensor unit 211 via wireless communication based on radio waves, a sensor unit 211, a control unit 226 configured to control the wireless transmission unit 225, and a manipulation unit 227 configured to check whether radio waves can be correctly sent when the human body sensor 21A is installed.

The control unit 226 is formed of, for example, a CPU configured to perform computation, ROM configured to store a control program, or RAM configured to temporarily store the results of computation. The control unit 226 comprehensively evaluates the results of the sensing of the sensor unit 211, more specifically the fact that an infrared sensor senses infrared rays at a specific wavelength or does not sense them, or the fact that it is determined by a illuminance sensor that the surrounding brightness is equal to or greater than a specific luminance, or is lower than the specific luminance, and determines whether to send a predetermined sensing signal or a non-sensing signal based on the results of the evaluation. The wireless transmission unit 225 converts the sensing signal or non-sensing signal sent from the control unit 226 into a radio wave signal at a predetermined frequency, and sends the resulting signal via the antenna 225*a*. The antenna 225*a* may be rotated around a horizontal shaft provided on the housing 210.

Furthermore, the wireless transmission unit 225 is provided with an oscillation circuit, so that it generates carrier radio waves at a predetermined frequency and then sends the carrier signal and the sensing signal with the sensing signal superimposed on the carrier signal. The manipulation unit 227 includes an operation mode switch 227*a* configured to switch between a common use mode and a registration mode upon making a new setting or changing the settings, a brightness setting trimmer 227*b* configured to set the brightness of a surrounding environment by automatically controlling the turning on and off of the lighting apparatus 203 based on the human body sensor 201A, a lighting time setting switch 227*c* configured to turn on the lighting apparatus 203 for a predetermined time period after the presence of a human is not sensed by the human body sensor 201A, and a determination switch 227*d* and a registration switch 227*e* configured to be used in registration mode.

Meanwhile, an increase in the length of a ground formed on the circuit board 220 is effective at reducing the size of the housing 210 of the human body sensor 201A and suppressing any reduction in the gain of the antenna. However, while reducing the size of the housing 210 as is required, it is necessary to concurrently enhance the ground of the wireless transmission unit 225 within the size confines of the circuit board 220. In this embodiment, the ground is enhanced by disposing the antenna 225*a* on one end side 220*a* and drawing the conductor 229 connected to the ground terminal (connector) 228 of the circuit board 220 from the other end side 220*b*, with the cutout portion of the circuit board 220 being disposed therebetween. That is, since the ground terminal 228 is connected to the ground on the other end side 220*b* of the circuit board 220, the ground of the wireless transmission unit 225 extends up to the front end of the conductor 229 to be formed throughout approximately entire circumference of the inside wall of the housing 210. Accordingly, the ground of the wireless transmission unit 225 is enhanced, thereby improving the gain of the antenna 225*a*. Furthermore, the length of the antenna 225*a* is preferably set such that the electrical length is approximately ¼ of the wavelength λ (lambda) of a carrier that is used in wireless communication.

The conductor 229 is a so-called counterpoise and extends from the other end 220*b* of the circuit board 220 to one end 220*a* thereof along the inside wall of the housing 210. Accordingly, in the housing 210 having a limited size, the length of the conductor 229 can be maximally achieved and the ground of the wireless transmission unit 225 can be efficiently enhanced. Here, since the electrical length from the other end 220*b* of the circuit board 220 to one end 220*a* thereof is designed to correspond to ¼ (quarter wavelength) of the wavelength λ of a carrier for a wireless signal, it is preferable that, in a well-known antenna gain test, the length of the conductor 229 is made variable and by using the length of the conductor 229 as a parameter, the length of the conductor 229 is determined such that the carrier for the wireless signal can be received in excess of a prescribed reception level in terms of design. The circuit board 220 (of course, except for the conductor 229) designed as described above is configured such that the total electrical length which is the sum of the overall equivalent electrical length of a wiring pattern and electric and electronic circuits on the circuit board 220 and the electrical length of the conductor 229 is equivalent to ¼ (quarter wavelength) of the wavelength of a carrier that is used in wireless communication.

Figure 11:
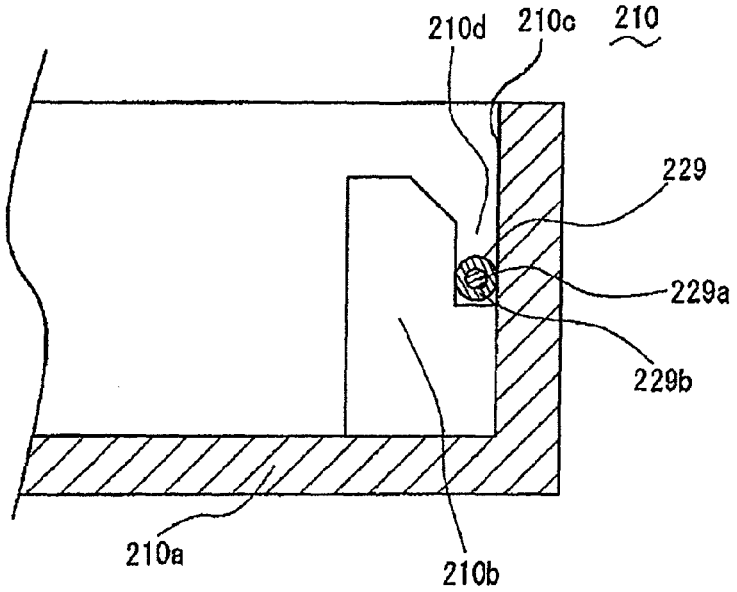
FIG. 11 is a sectional view showing the configuration of the peripheral portion of the housing of the human body sensor.

FIG. 11 shows the circumferential portion of the housing 210 and the section of the conductor. Ribs 210*b* are formed along the circumferential portion of the housing 210 at appropriate intervals. The ribs 210*b* are extended from the mounting surface 210*a* of the housing 210 and across the inside wall 210*c* of the circumferential portion, thereby increasing the strength of the housing 210. Furthermore, depressions 210*d* adapted to maintain the conductor 229 are formed in the portions where the ribs 210*b* and the inside wall 210*c* are joined to each other.

The conductor 229 includes a metallic line 229*a* and an insulating coating 229*b* formed on the surface of the metallic line 229*a*. The insulating coating 229*b* prevents a short circuit of the metallic line 229*a* with other electrical configurations. Furthermore, the width of the depressions 210*d* formed in the ribs 210*b* is the same or slightly smaller than that of the conductor 229. Accordingly, the conductor 229 is press-fitted into the depressions 210*d* and thus the conductor 229 is securely retained therein, thereby increasing the reliability of the function of improving the gain of the antenna 225*a*.

In the human body sensor 201A of this embodiment, the wireless transmission unit 225 is responsible for the transmission function of sending a sensing signal of the sensor unit 211 via wireless communication based on radio waves, and may vary depending on its purpose. For example, when the wireless apparatus of the present invention is applied to a wireless apparatus (in the above-described embodiment, switch 202) requiring wireless reception functionality, a wireless reception unit (wireless communication circuit) may be preferably used as a substitute for the wireless transmission unit 225. Furthermore, in an apparatus requiring both wireless transmission functionality and wireless reception function, the wireless transmission unit 225 and the wireless reception unit may be preferably provided. This means that targets to which the conductor 229 of the present invention is applied may be not only a wireless receiver but also a wireless transmitter, may be wireless transceivers, and the conductor 229 of the present invention may also be widely applied to general wireless apparatuses.

Fourth Embodiment

Figure 12:
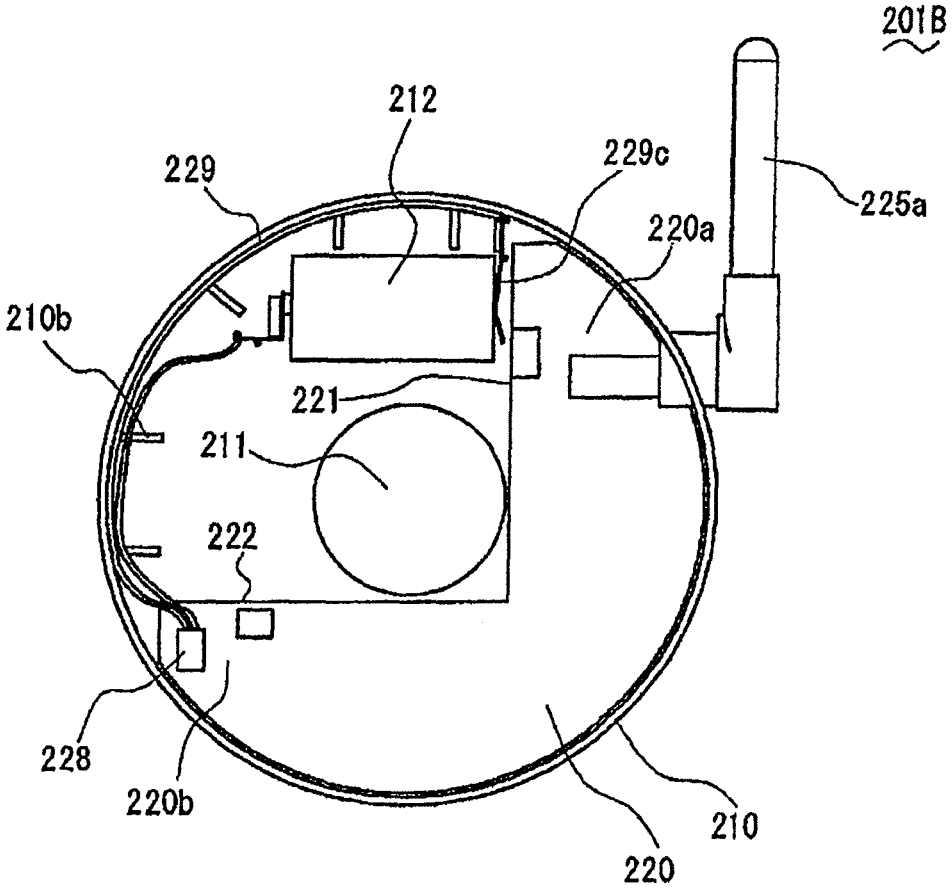
FIG. 12 is a front view showing the configuration of a human body sensor in accordance with a third embodiment of the present invention, with its cover removed.

FIG. 12 shows a human body sensor 201B using a wireless apparatus in accordance with a fourth embodiment. In the human body sensor 201B, a conductor 229 is directly connected to the negative electrode of the battery 212. That is, a terminal 229*c* that is connected to the negative electrode of the installed battery 212 is provided on the front end of the conductor 229 that is not connected to a ground terminal 228.

In accordance with the human body sensor 201B of the fourth embodiment, the front end of the conductor 229 is directly connected to the negative electrode of the battery 212, and thus it is not necessary to provide a separate conductor that connects the negative electrode of the battery 212 with the ground of the circuit board 220. Accordingly, the configuration of the human body sensor can be simplified, and the cost can be reduced.

Furthermore, the present invention is not limited to the configuration of the present embodiment, but may be at least configured such that an antenna 225*a* is disposed on one end side 220*a* of the circuit board 220 and the conductor 229 connected to the ground of the circuit board 220 extends from the other end side 220*b* thereof, with the cutout portion of the circuit board 220 being disposed therebetween.

Furthermore, the present invention may be variously modified, and thus the length or shape of the conductor that extends the ground may be selected depending on the wavelength of radio waves that are used in communication. For example, the conductor 229 of a length corresponding to the wavelength can be securely maintained by forming the ribs 210*b* along the entire inside wall of the housing 210 and disposing the conductor 229 along the entire inside wall of the housing 210, if desired. Furthermore, the length of the ground can be increased by winding the conductor 11 around a spirally shaped object or forming the conductor 11 in a meandering shape along the inside wall of the housing 210. Furthermore, the connection between the conductor 229 and the ground is not limited to the connection using the connector shown in FIG. 10 or the like, but may be a connection using soldering.

Figure 13:
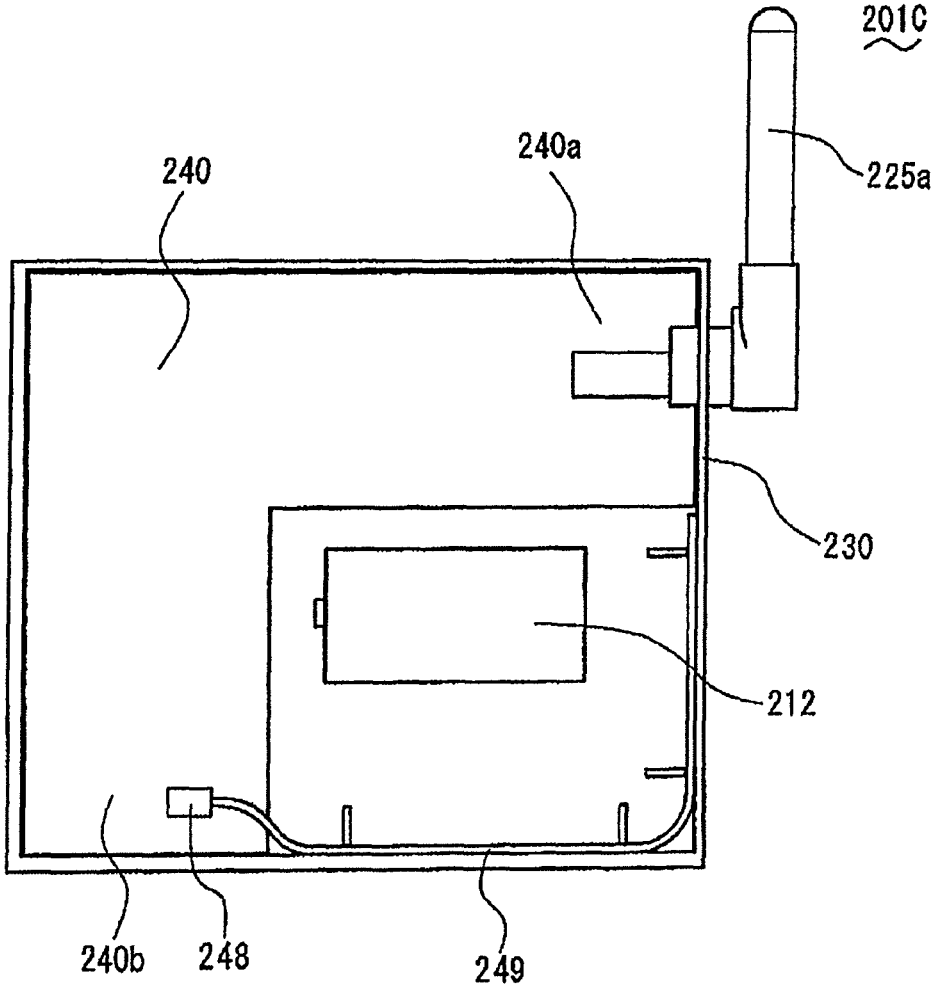
FIG. 13 is a front view showing the configuration of an electronic apparatus which contains the wireless apparatus, which is a modified example of the prevent invention, with its cover removed.

Furthermore, the wireless apparatus is not limited to the above-described disk-shaped human body sensor, but may be widely applied to, for example, typical box-shaped electronic apparatuses having wireless communication functionality, such as that shown in FIG. 13. The wireless apparatus of such an electronic apparatus 201C includes an antenna 225*a*, a circuit board 240 configured to form a wireless communication circuit, a battery 212 disposed in the cutout portion of the circuit board 240, and a housing 230 configured to accommodate the circuit board 240 and the battery 212. The antenna 225*a* is disposed on one end side 240*a* of the circuit board 240 and a conductor 249 connected to the ground terminal 248 of the circuit board 240 is drawn from the other end side 240*b* thereof, with the cutout portion being disposed therebetween. In this electronic apparatus 201C, it is preferred in terms of the enhancement of the ground of the circuit board 240 that the conductor 249 extend to the one end side 240*a* of the circuit board 240 along the inside wall of the housing 230.

What is claimed is:

1. A wireless apparatus comprising:

an antenna;

a circuit board comprising a wireless communication circuit that is connected to the antenna; and a resin molded housing that accommodates the circuit board, wherein a linear conductor extends from a ground of the circuit board, the entire antenna is accommodated inside the housing and is disposed between the circuit board and an attachment surface of the housing, the conductor is disposed on a same plane as the circuit board or is disposed opposite to the antenna with the circuit board between the antenna and the conductor, the antenna extends, from a connection to the circuit board, along an inner side of a wall of the housing in a first direction, the conductor extends, from the ground, along the inner side of the wall of the housing in a second direction, which is opposite to the first direction, and the antenna extends substantially perpendicular to the circuit board and is bent by approximately 90 degrees to extend parallel to the circuit board, and a distance between the circuit board and a portion of the antenna which extends parallel to the circuit board is based on a frequency of a carrier that is used in wireless communication, wherein a sensor, a speaker, and a battery adapted to supply power to the wireless communication circuit of the circuit board are provided in the housing, the sensor, the speaker, and the battery do not overlap one another when seen from the attachment surface, and the antenna is bent not to interfere with the sensor and the battery.

2. The wireless apparatus of claim 1, wherein a total electrical length, which is a sum of an overall equivalent electrical length of a wiring pattern and electrical and electronic circuits on the circuit board, except for the antenna, and an electrical length of the conductor, is ¼ of a wavelength of the carrier that is used in the wireless communication.

3. The wireless apparatus of claim 1, wherein ribs adapted to reinforce the housing are provided on the inner side of the wall of the housing, the ribs having depressions that receive the conductor.

4. The wireless apparatus of claim 1, wherein a surface of the conductor is provided with an insulating coating.

5. The wireless apparatus of claim 1, wherein a front end of the conductor that is not directly connected to the ground is directly connected to a negative electrode of the battery.

6. A wireless abnormality notification system comprising a plurality of fire alarms each including the wireless apparatus set forth in claim 1 and a sound notifier configured to issue a sound of an alarm, wherein one of the plurality of fire alarms that senses a fire wirelessly communicates with other fire alarms of the plurality of fire alarms and provides notification of the fire to the other fire alarms, so that the sound notifier of at least one of the plurality of fire alarms issues a sound to provide a notification of the fire.

7. A wireless remote control system comprising:

the wireless apparatus set forth in claim 1, a receiver configured to receive a wireless signal from the wireless apparatus, and an equipment, wherein the receiver controls an operation of the equipment.

8. The wireless apparatus of claim 2, wherein a length of the conductor is determined such that the total electrical length is ¼ of the wavelength of the carrier.

9. The wireless apparatus of claim 1, wherein a first portion of the antenna extends along the inner side of the wall of the housing, a second portion of the antenna extends between the speaker and the battery and a third portion of the antenna extends between the speaker and the sensor.

* * * * *